United States Patent [19]

Myers

[11] 4,071,192

[45] Jan. 31, 1978

[54] TRIBO-ELECTRO-GAS-DYNAMIC POWDER CHARGING APPARATUS

[75] Inventor: James Lewis Myers, Golden, Colo.

[73] Assignee: Coors Container Company, Golden, Colo.

[21] Appl. No.: 671,354

[22] Filed: Mar. 29, 1976

[51] Int. Cl.[2] ..... B05B 5/00; B44D 1/12

[52] U.S. Cl. ..... 239/3; 239/434; 239/DIG. 7; 302/25; 361/227; 427/421

[58] Field of Search ..... 239/3, 15, 434, DIG. 7; 317/3; 302/24, 25; 427/25, 27, 28, 421; 118/621, 622, 629; 361/225–228

[56] References Cited

U.S. PATENT DOCUMENTS

| | | | |
|---|---|---|---|
| 3,724,755 | 4/1973 | Diamond et al. | 239/15 |
| 3,859,205 | 1/1975 | Reba et al. | 239/DIG. 7 X |
| 3,903,321 | 9/1975 | Schaad | 239/15 X |

FOREIGN PATENT DOCUMENTS

| | | | |
|---|---|---|---|
| 845,676 | 8/1960 | United Kingdom | 239/DIG. 7 |

*Primary Examiner*—Evon C. Blunk
*Assistant Examiner*—Andres Kashnikow
*Attorney, Agent, or Firm*—Bertha L. MacGregor; Kyle W. Rost

[57] ABSTRACT

A tribo-electro-gas-dynamic powder coating apparatus with an obstruction-free barrel having a semi-toroidal section throat at the inner end and having an opening at the outer end. An end cap is connected to the barrel end over the semi-toroidal section to form an annular chamber circumferentially surrounding the semi-toroidal section and having a clearance between the section and the end cap leading from the chamber to the barrel bore.

7 Claims, 3 Drawing Figures

TRIBO-ELECTRO-GAS-DYNAMIC POWDER CHARGING APPARATUS

BACKGROUND OF THE INVENTION

1. Field of the Invention

The invention relates to powder coating apparatus, more particularly to tribo-electro-gas-dynamic (TEGD) powder charging apparatus. The apparatus comprises a powder gun that is especially useful for coating deep recesses, for example inside surfaces of two piece aluminum beverage cans.

2. Description of the Prior Art

Presently known powder coating apparatus generally employs an externally applied electric field to charge the powders. A first type of electrostatic charging gun uses direct current high-voltage low-amperage electrical power to charge the powder particles as they leave the gun barrel. The voltage used ranges up to and in some cases exceeds 100,000 volts, creating a hazard that can cause fires from arcing and electrical shock to personnel. These types of high voltage power systems are expensive, require safety protection and are subject to failure and resultant system unreliability. Because of the position of the high voltage electrodes, an electrical field is produced between the electrodes and ground, which may be the workpiece, and if not specially protected the gun may be brought too close to the grounded workpiece or other grounded item and cause an arc. It is known that such a field, which is used to transport and guide the powder to the workpiece, greatly limits the ability of the powder to reach into any recesses in the workpiece because of he "Faraday Cage" effect.

A second type of gun in the prior art uses a set of electrodes within the body of the gun. The electrodes are arranged to have the powder pass between them with one electrode at ground and the other at high voltage of about 7,000 to 15,000 volts. This system has a smaller but finite electric field between the end of the gun barrel and the workpieces as compared to the first type of gun. Hence, the second type of gun has fewer Faraday Cage and arcing problems. This type of charging is commonly known as the electro-gas-dynamic (EGD) charging system.

In the prior art triboelectric charging has been attempted, with only limited success. The structure described in U.S. Pat. No. 3,903,321 to Schaad achieved some charging with polytetrafluroethylene as a gun material and with epoxide powders. The present invention may be constructed of steel, aluminum, or plastics as representative examples and is useful in charging not only epoxides but also epoxide-phenolics, acrylics, ionomers, and others.

Electrostatic charging by means of friction, or tribo charging, is thought to occur in several ways. One method is to cause the material to be charged to impinge on another surface by rolling, sliding, or bouncing. Another method may be to entrain the material to be charged in a charged fluid that shares the charge with the material. Another method may be to cause differential accelerations among particles of the material to be charged, causing friction between the particles.

A major problem occurs in the prior art when tribo charging of powder is attempted. Almost any powder will tribo charge if it is given sufficient rubbing contact; however, handling typical powders to get sufficient rubbing contact has undesirable consequences. If the powder is a thermoset curing resin, the material is always curing and the rate of cure is temperature dependent. Excessive rubbing can cause the powder to melt and adhere to the walls of tubes and passages, eventually clogging or fouling these passages. If the powder is propelled at a very high velocity in these passages and if the powder particles impact on objects and surfaces in these passages, the kinetic energy is converted to heat causing the powder particles to adhere and cure. This phenomenon is called "impact fusion" and can soon clog passages.

SUMMARY OF THE INVENTION

The invention relates to tribo-electro-gas-dynamic powder charging apparatus that is self cleaning and minimizes impact fushion. The apparatus is a gun having a semi-toroidal section at the inner end of a barrel bore and an adjustable clearance between the semi-toroidal section and an end cap that forms an annular clearance with the section. Propellant gas passing through the annular clearance is directed partially into the barrel throat by the coanda effect and partially into a zone between the barrel throat and a powder supply inlet, tribo charging the powder and also making the gun self cleaning. The gun may utilize powder charging means known in the prior art to create or augment the charge imparted to the powder and may be operated as either an aspirator or an ejector.

An object of the invention is to create an apparatus for charging powders without an independent applied electric current, either external or internal.

An important object is to create a powder charging apparatus with which deep recesses in the object may be coated as the result of the absence of an electrical field between the apparatus and the object to be coated.

Another object is to create a tribo charging apparatus that is self cleaning.

Another important object is to create an apparatus that may operate either as an aspirator or an ejector and which may, if necessary, use a corona discharge zone for charging or charge enhancement.

A further object is to create a tribo charging apparatus that allows any of the known mechanisms for tribo charging to operate, including impinging powder on another surface by rolling, sliding, or bouncing, entraining the powder in a fluid which has itself become charged by friction with the walls of the conduit in which it flows, and causing the powder to be charged to pass through a boundary separating a high velocity stream of a fluid and a lower velocity stream of the same or dissimilar fluid.

DESCRIPTION OF THE PREFERRED EMBODIMENT

Figure 1:
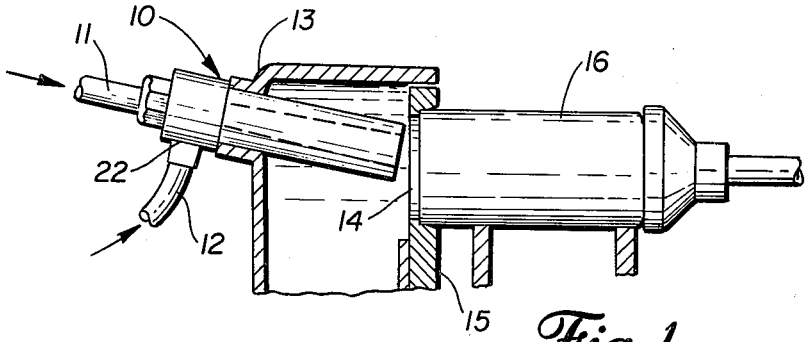
FIG. 1 is an elevational view in partial section showing the apparatus in combination with equipment with which it may be used.

The powder coating gun 10 as seen in FIG. 1 is intended for use in conjunction with a supply of compressed gas entering the gun through carrying means such as one of tubes 11 or 12 and with a supply of powder that may be entrained in a carrier gas entering through carrying means such as the other of tubes 11 and 12. The gun 10 may be supported by bracket 13 to aim through aperture 14 in mask plate 15. A workpiece such as can 16 may be inserted in aperture 14 to be coated internally by the gun 10.

Figure 2:
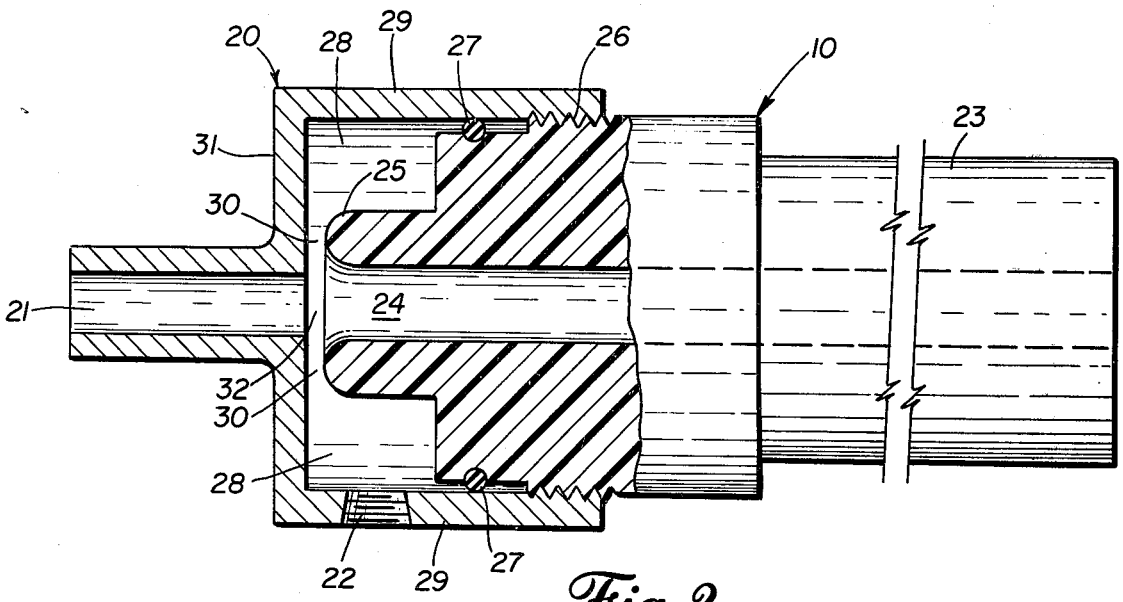
FIG. 2 is a longitudinal sectional view of the apparatus showing its main features.

As shown in FIG. 2, the apparatus comprises an end cap 20 which may have ports 21 and 22 and barrel 23 having throat 24 with a semi-toroidal section 25. The end cap 20 and barrel 23 are joined together by a connection such as threads 26. A seal 27 may be used to prevent escape of pressurized gas at the connection. An annular chamber 28 is formed circumferentially surrounding section 25 within circular side wall 29 of end cap 20. In addition, annular adjustable clearance 30 exists between section 25 and end wall 31 of end cap 20. Clearance 30 is adjusted by adjusting means, for example threaded connection 26. Zone 32 exists between barrel throat 24 and end wall 31 and within annular clearance 30.

In operation pressurized gas is forced into annular chamber 28, for example through port 22, and must pass through clearance 30 and into zone 32. As the gas passes through clearance 30, the stream becomes attached to the walls of cap 20 and section 25, and as the two walls begin to diverge and the gas expands into zone 32, part of the stream is directed into throat 24 by the coanda effect. The rest of the stream remains attached to the wall of end cap 20 until it reaches the point of powder delivery, such as the bore of port 21, at which point it detaches, creating turbulence and reduced pressure. Powder to be charged is normally delivered to port 21 entrained and dispersed in a suitable gas such as air, $CO_2$, $N_2$, or Ar. Since the flow in zone 32 is turbulent, many collisions occur between the particles themselves and between particles and the walls of the gun. Some gases, notably $CO_2$, also become charged and can either enhance or degrade the charge on the particle depending on the polarity of each. In this mode of operation, the powder to be charged and its entraining gas are fairly well mixed with the propellant gas by the turbulence in zone 32 and thus have access to the walls of the throat 24 of the gun for further frictional charging. The gun 10 is operating as an ejector in this mode and the highest velocity gas is at the wall of the throat 24, thus making the gun self cleaning.

The adjustable clearance between wall 31 of end cap 20 and semi-toroidal section 25 is an important feature in controlling throat velocities and volume. At a given inlet gas pressure, decreasing the clearance will increase velocity and decrease volume. At a given clearance, increasing inlet pressure at port 22 increases volume and velocity. These adjustments also influence the suction at port 21.

Compressed propellant gas is the power source for charging powder in the gun. Some of the factors that influence the charge produced with this gun are the specific powder used, the powder delivery rate to the gun, and propellant gas flow to the gun. For example, with Celanese powder MDS 117A at 0.500 gm./sec. delivery rate and 4.7 cubic feet/min. (cfm) gas flow, the gun produced a charge of 5.0 microcoulombs/gm. Under the same conditions with DuPont Surlyn powder, a thermoplastic ionomer, the gun produced 3.8 microcoulombs/gm. Other variations in gas flow, powder flow, and powder type as well as variations in gap 30 make this gun more versatile than prior art devices.

The apparatus may also be operated as an aspirator with gas being injected at port 21 producing a reduced pressure at port 22, where the powder to be charged is introduced. This mode of operation has the advantage of offering more time and wall surface area for frictional charging; however, this advantage is offset if the powder to be charged has a tendency to agglommerate since the reduced powder velocities resulting from operation in the aspirator mode are sometimes insufficient to keep the individual particles dispersed long enough for mutual repulsion to become a dominant factor in preventing the powder from agglomerating.

Figure 3:
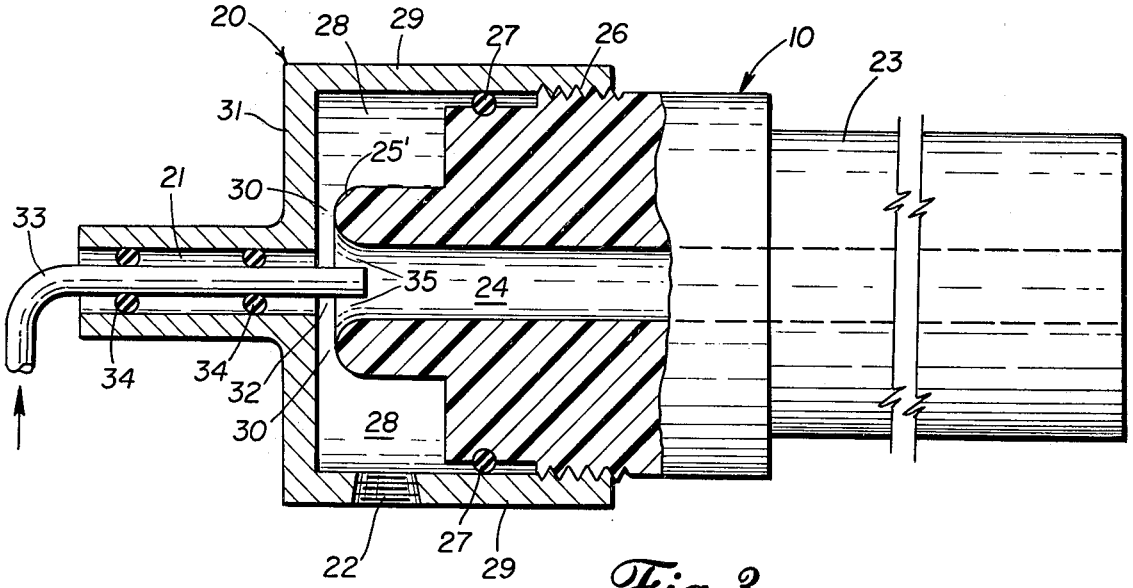
FIG. 3 is a longitudinal sectional view of a modification of the apparatus.

The modification of FIG. 3 includes an electrically conductive tube 33, which may be insulated from the barrel, for example at end cap 20 by rubber rings 34, and an electrically conductive portion of the barrel, such as semi-toroidal section 25'. If the chosen powder does not tend to agglomerate, the aspirator mode of operation allows an external voltage source to be connected to the gun to charge powders with low tribo charging characteristics. The propellant gas is introduced through tube 33 in port 21 and a sufficiently high voltage is impressed across the gap 35 between tube 33 and section 25' to cause a corona discharge, charging the powder particles passing through it.

The materials used in the construction of the gun seem to exert a strong influence on its performance. While the interelationship between the electrical characteristics and physical properties of both gun and powder is not fully understood, it is apparent that some gun materials give better results with a given powder than others. If, for instance, relatively flat panels are to be coated, a high voltage electrical field between gun and target not only guides charged particles to the object to be coated, thus reducing overspray, but apparently increases the charge level on the particle while in transit and even after deposition. This field can be produced and maintained by choosing a gun material that is relatively non-conductive, for example acetal plastic, glass filled epoxy, or acrylic plastic. The gun barrel then acts as a capacitor which is constantly being recharged. Extremely high voltages, i.e., 100–200KV have been observed at the gun muzzle when constructed of acetal plastic and carefully insulated from its support.

When coating deep recesses, or when an external electrical field is not desired for some other reason, the gun barrel may either be covered with a conductive shield held at gound potential or constructed of a conductive material, such as a metal, if appropriate, and the entire gun grounded. A D.C. ammeter may be inserted in the ground circuit in order to monitor gun performance. Cylinders closed at one end with a height to diameter ratio as high as 2.2:1 have been successfully coated internally, but only when the external field was absent.

I claim:

1. A method of tribo-charging powder comprising a. directing a propellant gas radially inwardly past a semi-toroidal section at the inner end of a barrel having a non-decreasing inner diameter from the inner end of the barrel to the outer end of the barrel, a first portion of said propellant gas following the semi-toroidal section under influence of the coanda effect to form a boundary layer against the inner wall of the barrel, and a second portion of the propellant gas detaching from the semi-toroidal section in turbulent fashion, b. directing a supply of powder into said inner end of the barrel along a path axially aligned with the barrel axis and of path width no greater than the smallest diameter of the barrel at the inner end thereof, c. turbulently mixing said powder with said second portion of the propellant gas in a zone near the inner end of the barrel, and d. propelling said powder from the inner end through the outer end of the barrel under influence of the propellant gas to tribocharge the powder.

2. A tribo-electro-gas-dynamic powder coating apparatus for use with a supply of propellant gas and a supply of powder, comprising a. a barrel having a throat at one end thereof and having an opening at an opposite end thereof, said throat having a semi-toroidal section, the inner diameter of the barrel being non-decreasing in diameter between the semi-toroidal section and the opening for clog-free performance, b. an end cap having an end wall and connected to the barrel over said throat and semi-toroidal section and forming a chamber circumferentially surrounding the semi-toroidal section, providing a clearance between the semi-toroidal section and said end wall of the end cap, and forming a zone between said throat and the end wall, c. means delivering said propellant gas to said chamber, the gas passing through the clearance between the semi-toroidal section and the end cap and a first portion of the gas entering the throat of the barrel in a high velocity stream adjacent the wall of the throat to make the apparatus self-cleaning, and d. means delivering said powder to said zone adjacent to the end cap for turbulent mixing with a second portion of said propellant gas and subsequent tribocharging in said throat, the powder delivering means comprising a port axially aligned with the barrel throat and of diameter no larger than the minimum diameter of the throat to prevent impact fusion of the powder against the throat or semi-toroidal section.

3. The apparatus of claim 2, further comprising means for adjusting said clearance between the semi-toroidal section and the end wall of the end cap.

4. The apparatus of claim 3, wherein said means for adjusting said clearance is a threaded connection joining the barrel and the end cap.

5. The apparatus of claim 2, wherein said powder delivering means includes a carrier gas entraining said powder.

6. A tribo-electro-gas-dynamic powder coating apparatus for use with a supply of propellant gas and a supply of powder, comprising a. a barrel having a throat with an electrically conductive portion and having a semi-toroidal section at one end thereof, b. an end cap having an end wall and connected to the barrel over said throat and semi-toroidal section and forming a chamber circumferentially surrounding the semi-toroidal section, providing a clearance between the semi-toroidal section and said end wall of the end cap, and forming a zone between said throat and the end wall, c. means delivering said propellant gas to said chamber, d. a tube constructed of electrically conductive material delivering propellant gas to said barrel and having a gap between the tube and the electrically conductive portion of the barrel, e. insulating means preventing electrical connection between the tube and the electrically conductive portion of the barrel other than across said gap, and f. an external source of high voltage applied across said gap producing a corona discharge for charging powder particles.

7. The apparatus of claim 6, wherein the electrically conductive portion of the barrel comprises said semi-toroidal section.

* * * * *